US010207301B2

(12) United States Patent
Bohrer et al.

(10) Patent No.: US 10,207,301 B2
(45) Date of Patent: Feb. 19, 2019

(54) APPARATUS AND METHOD OF FOR CLEANING A THERMOSTAT IN AN INTERNAL COMBUSTION ENGINE

(71) Applicants: Greg Bohrer, St. Peters, MO (US); Tina Bohrer, St. Peters, MO (US)

(72) Inventors: Greg Bohrer, St. Peters, MO (US); Tina Bohrer, St. Peters, MO (US)

( * ) Notice: Subject to any disclaimer, the term of this patent is extended or adjusted under 35 U.S.C. 154(b) by 274 days.

(21) Appl. No.: 14/924,120

(22) Filed: Oct. 27, 2015

(65) Prior Publication Data

US 2016/0333766 A1 Nov. 17, 2016

Related U.S. Application Data

(60) Provisional application No. 62/160,431, filed on May 12, 2015.

(51) Int. Cl.
*F01P 11/06* (2006.01)
*B08B 9/00* (2006.01)

(52) U.S. Cl.
CPC ..... *B08B 9/00* (2013.01); *F01P 11/06* (2013.01); *F01P 2031/32* (2013.01)

(58) Field of Classification Search
USPC ..... 137/245.5, 540
See application file for complete search history.

(56) References Cited

U.S. PATENT DOCUMENTS

| | | | | |
|---|---|---|---|---|
| 3,540,528 | A | 11/1970 | Moon | |
| 4,619,618 | A | 10/1986 | Patti | |
| 4,669,988 | A * | 6/1987 | Breckenfeld | F01P 3/202 123/41.13 |
| 5,170,752 | A | 12/1992 | Binversie et al. | |
| 5,980,342 | A | 11/1999 | Logan et al. | |
| 6,390,870 | B1 | 5/2002 | Hughes et al. | |
| 6,679,431 | B1 | 1/2004 | Mathew et al. | |
| 6,997,766 | B1 | 2/2006 | Brogdon et al. | |
| 8,296,892 | B2 * | 10/2012 | Del Rosso | B08B 9/00 137/242 |

* cited by examiner

*Primary Examiner* — Ned Landrum
*Assistant Examiner* — Nicholas S Hector
(74) *Attorney, Agent, or Firm* — Sandberg Phoenix & von Gontard PC

(57) ABSTRACT

A thermostat assembly for a marine engine, having a housing with a first bore and a second bore in communication with the first bore. A thermostat mounts within the first bore for movement between an open and a closed position. A plunger removably mounts within the second bore for movement between an extended position for engagement with the thermostat, and a retracted position for disengagement with the thermostat.

12 Claims, 7 Drawing Sheets

APPARATUS AND METHOD OF FOR CLEANING A THERMOSTAT IN AN INTERNAL COMBUSTION ENGINE

CROSS-REFERENCE TO RELATED APPLICATIONS

This is a United States non-provisional application that claims priority to and the benefit of U.S. Provisional Application 62/160,431, filed May 12, 2015.

STATEMENT REGARDING FEDERALLY SPONSORED RESEARCH

Not applicable.

BACKGROUND

The present invention relates to cooling systems for marine inboard engines. More particularly, the present invention relates to an apparatus and method for cleaning a thermostat and thermostat housing for a marine inboard engine.

Marine inboard engines generally use open or closed cooling systems to maintain proper operation temperature of the engine. Typically, an open cooling system uses a thermostat assembly to regulate the temperature of the cooling water and keep pressure in the cooling system to facilitate heat transfer from the heads and the cylinder walls. Generally, if the engine temperature is too hot, the thermostat opens to allow more water into the engine. If the engine is too cold, the thermostat closes so that the water cannot enter the engine to cool it.

More specifically, a circulation pump draws water from the body of water the vessel is on into the cooling system. If the engine is cold, the thermostat assembly routes the water to an exhaust where it is passed overboard. The water contained in the engine remains in essentially a closed circuit moving from the engine cooling passages to the thermostat assembly to the engine circulating pump then back to the engine cooling passages. As the temperature of the water passing through the thermostat assembly increases, the thermostat begins to open allowing the hot water to be sent to the exhaust where it is discharged overboard (FIG. 14). The thermostat assembly also allows the incoming cold water to mix with the hot engine discharge water. This cooler water is now routed to an engine circulating pump and then to the engines cooling passages. As the water temperature fluctuates the amount of cold water added to the engines circulating system is controlled by adjusting the discharge path of the water. If the engine is too hot, water is allowed to discharge via the exhaust and more cold water is introduced into the engine's circulating system. If the temperature is too cold, the cold water bypasses the engine's circulating system and is discharged overboard.

If the water quality drawn from the body of water is poor, debris can cause malfunctioning of the thermostat. Malfunctioning of the thermostat can cause the engine to function improperly or even damage the engine. For example, if the thermostat becomes stuck in an open position it will cause overcooling of the engine. If the thermostat becomes stuck closed, it will cause overheating of the engine. Cleaning or clearing the debris from the thermostat and housing can be troublesome. Typically, it requires tools to disassemble the housing and removal of the thermostat.

Therefore, what is needed is an apparatus and method for cleaning or clearing the thermostat and housing without the need for tools, disassembly, or removal of the thermostat.

DESCRIPTION OF THE DRAWINGS

In the accompanying drawings which form part of the specification.

Corresponding reference numerals indicate corresponding parts throughout the several figures of the drawings.

DETAILED DESCRIPTION

Figure 1:
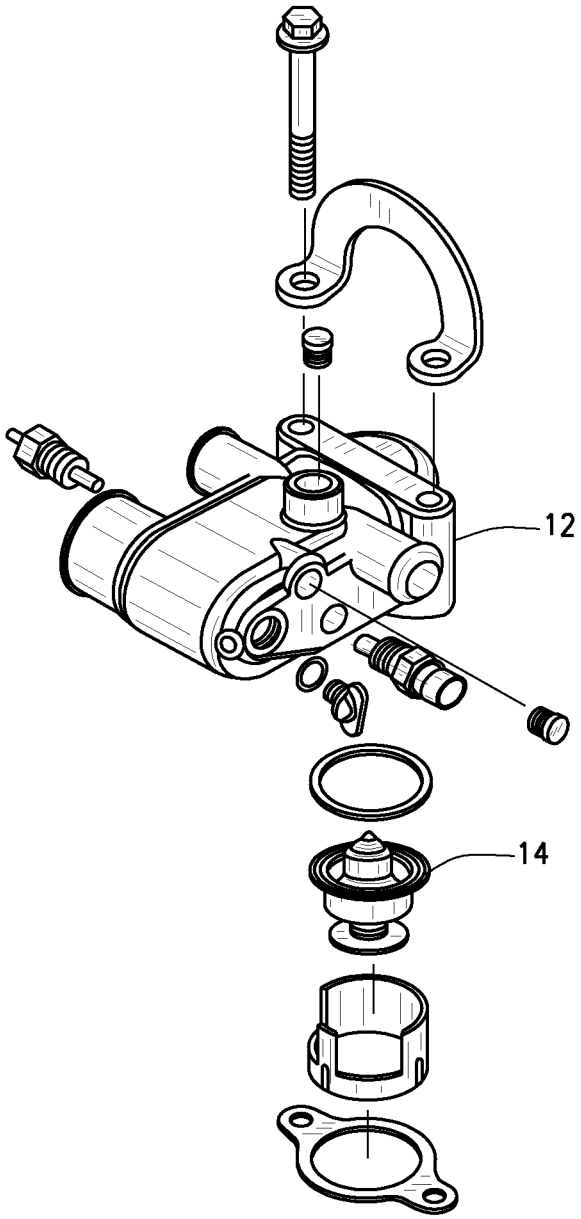
FIG. 1 is an exploded perspective view of a thermostat assembly, which is constructed in accordance with the present disclosure.
Figure 2:
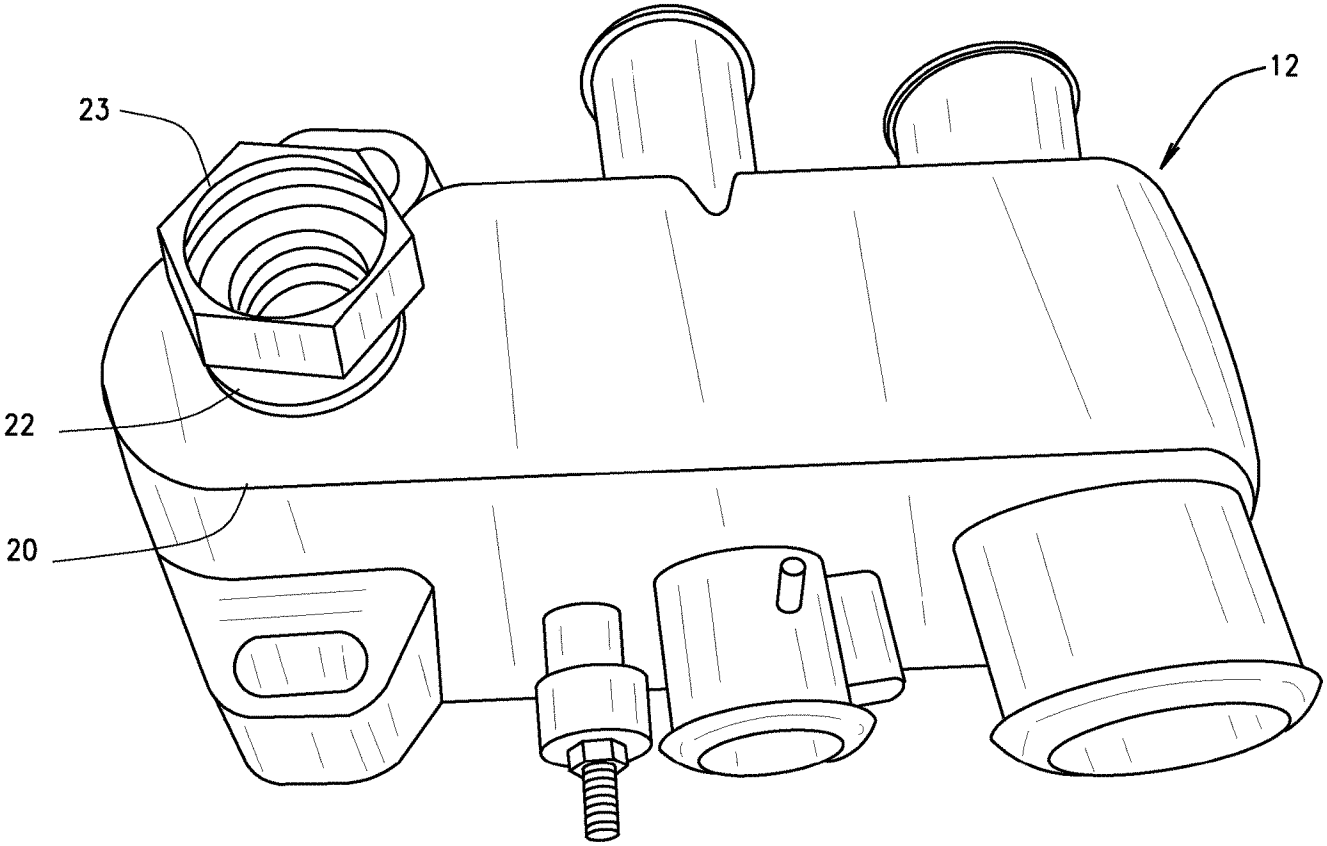
FIG. 2 is an upper perspective view of a thermostat housing.
Figure 3:
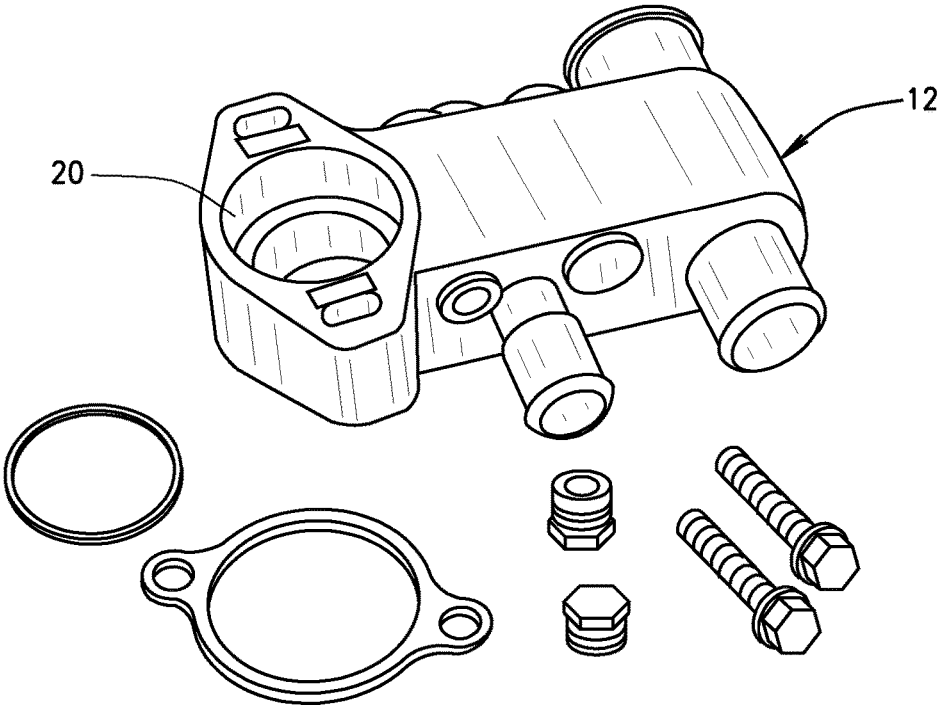
FIG. 3 is a lower perspective view of the thermostat housing.
Figure 4:
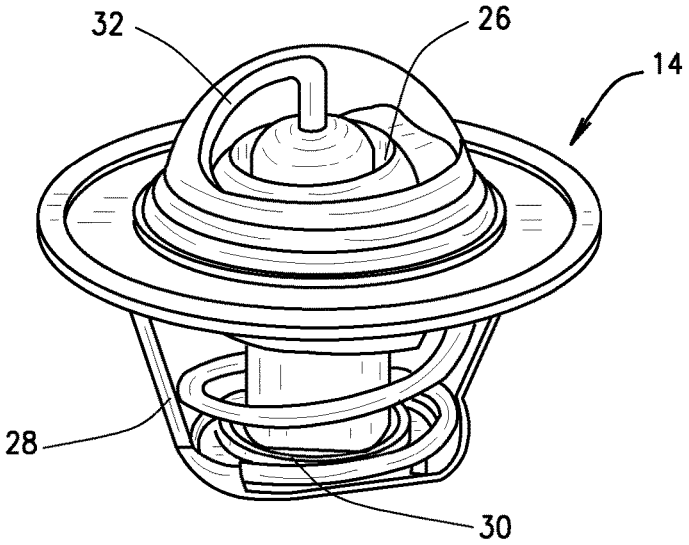
FIG. 4 is a perspective view of a thermostat.
Figure 5:
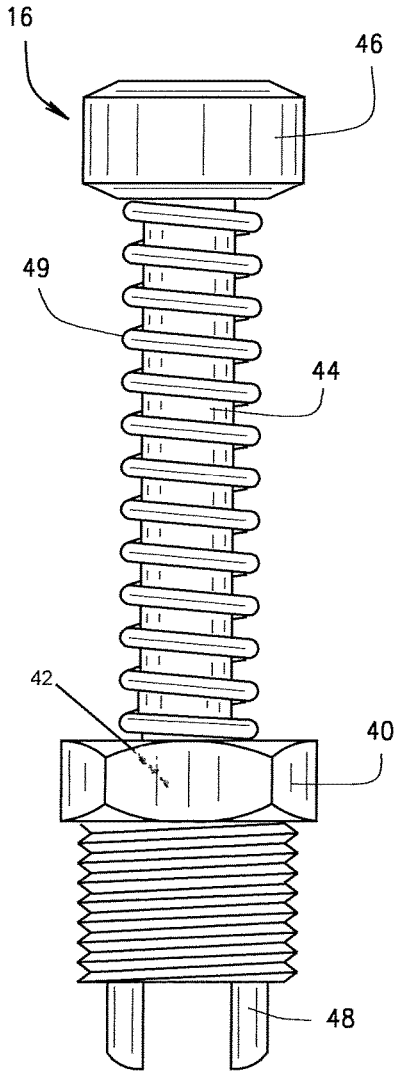
FIG. 5 is a side view of a thermostat cleaning apparatus in a retracted position.
Figure 6:
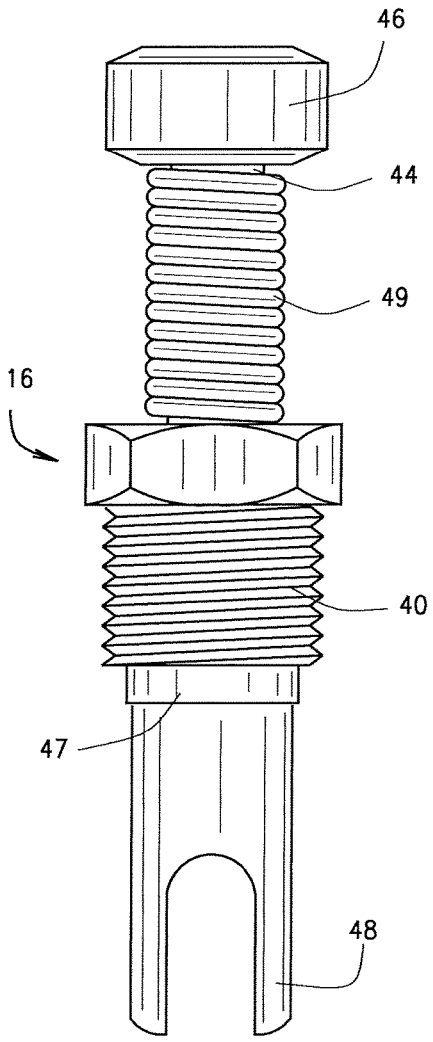
FIG. 6 is a side view of the thermostat cleaning device in an extended position.
Figure 7A:
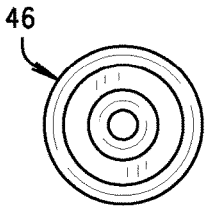
FIG. 7A is a top view of a stem handle.
Figure 7B:
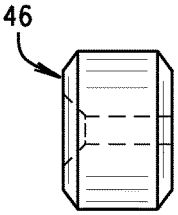
FIG. 7B is a side view of the stem handle.
Figure 8A:
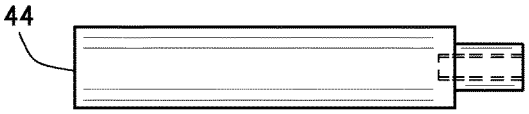
FIG. 8A is a side view of a stem.
Figure 8B:
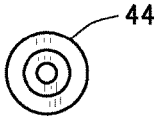
FIG. 8B is a top view of the stem.
Figure 9A:
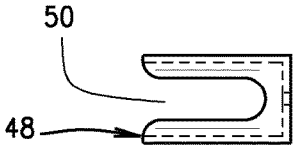
FIG. 9A is a side view of a thermostat adapter.
Figure 9B:
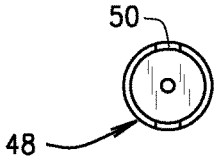
FIG. 9B is a top view of the thermostat adapter.
Figure 10A:
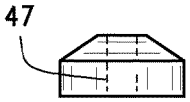
FIG. 10A is a side view of a stem seal.
Figure 10B:
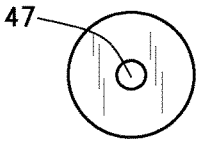
FIG. 10B is a top view of the stem seal.

The following detailed description illustrates the claimed invention by way of example and not by way of limitation. The description clearly enables one skilled in the art to make and use the disclosure, describes several embodiments, adaptations, variations, alternatives, and uses of the disclosure, including what is presently believed to be the best mode of carrying out the claimed invention. Additionally, it is to be understood that the disclosure is not limited in its application to the details of construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting.

As shown in FIGS. 1-14, an embodiment constructed in accordance with the present disclosure, generally referred to as a thermostat assembly 10, includes a housing 12, a thermostat 14 removably mounted within the housing 12, and a cleaning plunger device 16 in operative communication with the thermostat 14 for clearing the thermostat 14 of debris.

Figure 14:
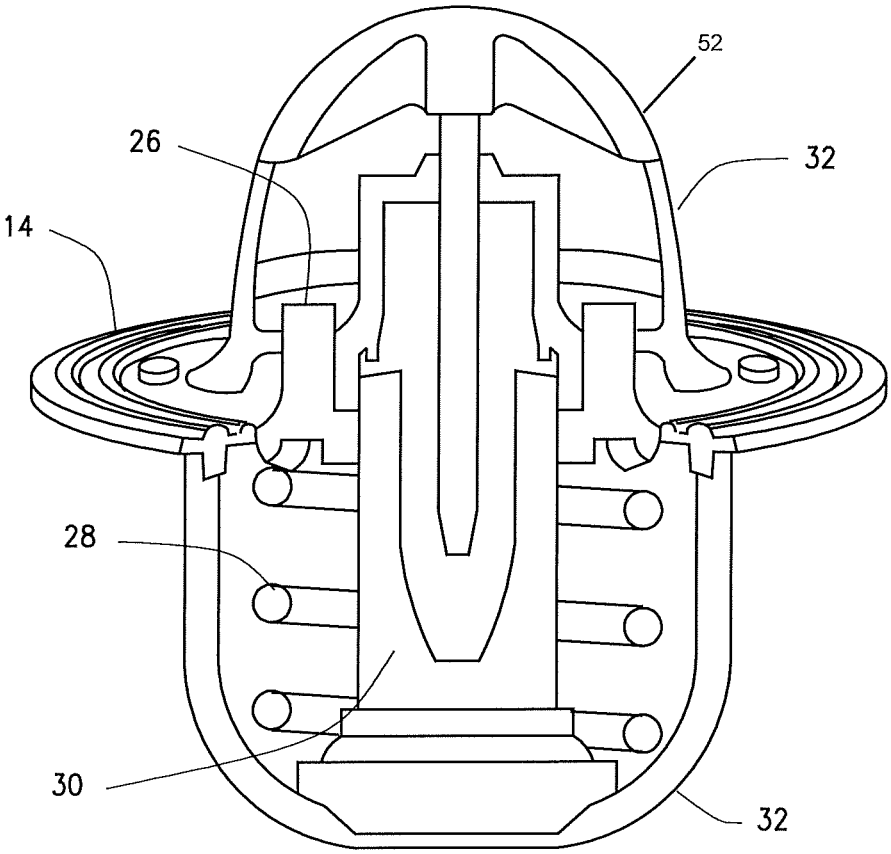
FIG. 14 is a partial cross-section illustration of the thermostat in an open position.

The housing 12 is generally rectangular with various inlet, outlet, and internal passages 18 for communicating cooling water and a first bore 20 configured for receiving the thermostat 14. The first bore 20 and thermostat 14 are configured for metering the incoming cooling water to mix with the hot engine discharge water (FIG. 14). For example, as the engine temperature fluctuates, the thermostat 14 moves between a closed position and an open position to meter the amount of cooling water added to the engines circulating system. If the engine temperature is too hot, the thermostat 14 moves to the open position and allows more cooling water cold water. If the engine temperature is too cold, the thermostat 14 moves towards the closed position and allows less cooling water.

Figure 11:
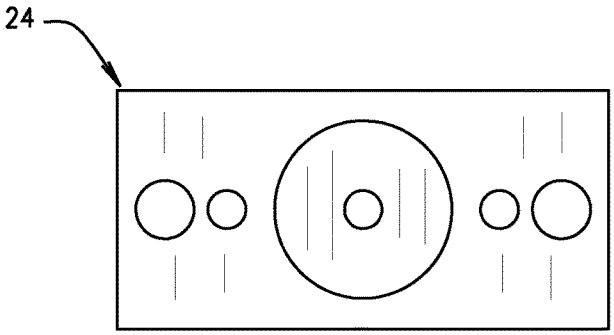
FIG. 11 is a top view of a thermostat housing fixture.

The housing 12 defines a second bore 22 in the opposite side of the housing from the first bore 20 and extending far enough to be in communication with the first bore 20. The second bore 22 is shaped to receive a fitting 40 for coupling with the plunger device 16. The second bore 22 can either be manufactured as part of the original housing 12, or drilled into the housing 12 afterwards using a fixture 24 (FIG. 11). In the embodiment of FIGS. 1-14, the embodiment of the housing shown is derived from one manufactured by Mercury® for use in Mercrusier® line of engines. However, those skilled in the art will recognize that other types and brands of thermostat housings can also be used.

Figure 12:
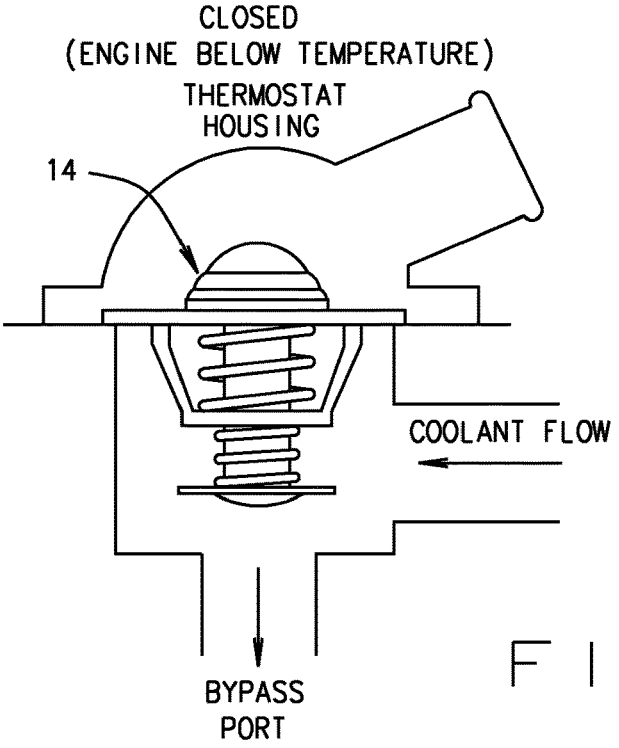
FIG. 12 is a cross-section view of the thermostat.
Figure 13:
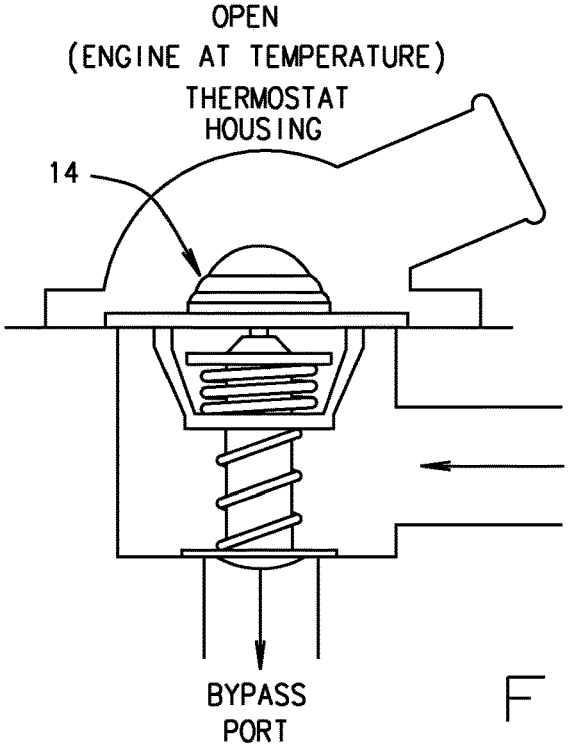
FIG. 13 is a partial cross-section illustration of the thermostat in an closed position.

The thermostat 14 includes a valve 26, a return spring 28, and a bypass valve 30 operatively mounted within a frame 32 for movement between an open position and a closed position (FIGS. 12-13). In the embodiment of FIGS. 1-14, the thermostat is a thermostat manufactured by Mercury® for the Mercruiser® line of engines. However, those skilled in the art will recognize that other types and brands of thermostats can also be used. For example, the thermostat can have an electronic actuation instead of a mechanical actuation, such as the return spring.

The plunger device 16 includes a fitting 40 configured for coupling with the second bore 22, such as with threads. The fitting 40 defines a bore 42 sized and shaped for receiving a stem 44. The stem 44 is generally a cylindrical rod having a generally cylindrical handle 46 removably attached to an upper end. A lower end of the stem 44 is configured for removable attachment to an adapter 48 and a seal 47. The adapter 48 is sized and shaped to engage the valve 26 of the thermostat 14 when the plunger device 16 moves to the extended position. A biasing member 49, such as a spring, biases the plunger device 16 to the retracted position. In the embodiment of FIGS. 1-14, the adapter 48 is a generally hollow cylinder having a pair of parallel slots 50. This configuration allows the adapter 48 to extend past the upper portion 52 of the thermostat frame 32 to engage the valve 26. However, those skilled in the art will recognize that the adapter can be configured in any shape to allow the plunger device 16 to engage the valve of the thermostat 14.

In operation, the operator presses downwardly on the handle of the plunger device 16 to move from a retracted position to an extended position. In the extended position, the adapter 48 engages the valve of the thermostat for movement from the closed to the open position so that any debris can be flushed from the thermostat 14. When the operator releases the handle 46, the biasing member 49 returns the plunger device to the retracted position, and the thermostat returns to the closed position, thus resuming normal operation.

Changes can be made in the above constructions without departing from the scope of the disclosure, it is intended that all matter contained in the above description or shown in the accompanying drawings shall be interpreted as illustrative and not in a limiting sense.

What is claimed is:

1. A thermostat assembly for a marine engine, comprising:

a housing integrally comprising a first bore and a second bore in communication with the first bore;

a thermostat mounted within the first bore, the thermostat configured for movement between an open position and a closed position;

a plunger removably mounted within the second bore for movement between an extended position for engagement with the thermostat and a retracted position for disengagement with the thermostat; whereby the plunger mounted in the second bore is configured to be brought into engagement with the thermostat mounted in the first bore to clean the thermostat.

2. The thermostat assembly of claim 1, the plunger comprising:

a fitting defining a bore;

a stem configured to insert through the bore of the fitting for movement between the retracted position and the extended position;

an adapter connected to a lower end of the stem, the adapter being sized and shaped to engage the thermostat;

a seal seated against an upper end of the adapter; and a biasing member configured to bias the stem and the adapter to the retracted position.

3. The thermostat assembly of claim 2, the adapter further comprising a slot that is sized and shaped to receive an upper portion of the thermostat.

4. The thermostat assembly of claim 1, the thermostat, comprising:

a frame;

a bypass valve mounted within the frame for movement between the open position and the closed position; and a return spring mounted with the frame and configured to bias the bypass valve to the closed position.

5. The thermostat assembly of claim 2 wherein the stem is cylindrical, the adapter comprises a U-shaped slot, the biasing member is a spring, and wherein the plunger further comprises a handle connected to the upper end of the stem.

6. A plunger assembly for cleaning a thermostat assembly for a marine engine, comprising:

a fitting defining a bore;

a stem configured to insert through the bore of the fitting for movement between a retracted position and an extended position;

an adapter connected to a lower end of the stem, the adapter being sized and shaped to engage a thermostat included in the thermostat assembly for the marine engine;

a seal seated against an upper end of the adapter;

a biasing member configured to bias the stem and the adapter to the retracted position; and wherein the plunger assembly is mounted in a second bore of a housing comprised by the thermostat assembly for the marine engine and is configured to be brought into engagement with the thermostat which is mounted in a first bore of the housing comprised by the thermostat assembly for the marine engine, said housing integrally comprising the first bore and the second bore in communication with the first bore, to clean the thermostat.

7. The plunger assembly of claim 6, the adapter further comprising a slot that is sized and shaped to receive an upper portion of the of the thermostat.

8. The plunger assembly of claim 6, wherein the thermostat, comprises:

a frame;

a bypass valve mounted within the frame for movement between an open position and a closed position; and a return spring mounted with the frame and configured to bias the bypass valve to the closed position.

9. A method of cleaning a thermostat assembly for a marine engine, comprising:

providing a housing having a first bore and a second bore in communication with the first bore;

providing a thermostat mounted within the first bore, the thermostat configured for movement between an open position and a closed position;

providing a plunger;

positioning the plunger within the second bore; and moving the plunger between an extended position for engagement with the thermostat and a retracted position for disengagement with the thermostat.

10. The method of cleaning a thermostat assembly of claim 9, the thermostat comprising:

a frame;

a bypass valve mounted within the frame for movement between the open position and the closed position; and a return spring mounted with the frame and configured to bias the bypass valve to the closed position.

11. The method of cleaning a thermostat assembly of claim 9, the plunger comprising:

a fitting defining a bore;

a stem configured to insert through the bore of the fitting for movement between the retracted position and the extended position;

an adapter connected to a lower end of the stem, the adapter being sized and shaped to engage the thermostat;

a seal seated against an upper end of the adapter; and a biasing member configured to bias the stem and adapter to the retracted position.

12. The method of cleaning a thermostat assembly of claim 11, the adapter further comprising a slot that is sized and shaped to receive an upper portion of the thermostat.

* * * * *